US005562234A

United States Patent [19]

Su

[11] Patent Number: 5,562,234

[45] Date of Patent: Oct. 8, 1996

[54] HAND SPRAYER

[76] Inventor: Cheng-Yuan Su, P.O. Box 438, Hsinchu City, Taiwan

[21] Appl. No.: 542,015

[22] Filed: Oct. 12, 1995

[51] Int. Cl.[6] ..... B67D 5/42

[52] U.S. Cl. ..... 222/321.2; 222/321.9; 239/590

[58] Field of Search ..... 222/321.2, 321.7, 222/321.8, 321.9, 382, 383.1, 385; 239/333, 590, 590.5

[56] References Cited

U.S. PATENT DOCUMENTS

| | | | |
|---|---|---|---|
| 3,288,378 | 11/1966 | Dobson | 239/590 |
| 3,702,175 | 11/1972 | Watkins | 239/590 |
| 4,025,046 | 5/1977 | Boris | 222/321.2 |
| 4,277,001 | 7/1981 | Nozawa | 222/321.4 |
| 4,305,530 | 12/1981 | Nozawa | 222/385 |
| 4,369,900 | 1/1983 | Saito et al. | 222/321.2 |
| 4,378,088 | 3/1983 | Ewing | 239/590.5 |
| 4,462,549 | 7/1984 | Saito et al. | 222/385 |
| 4,606,479 | 8/1986 | Van Brocklin | 239/333 |
| 4,821,928 | 4/1989 | Su | 239/333 |
| 4,930,999 | 6/1990 | Brunet et al. | 417/552 |
| 5,370,280 | 12/1994 | Su | 222/385 |

FOREIGN PATENT DOCUMENTS

| | | |
|---|---|---|
| 2314772 | 1/1977 | France . |
| 2512517 | 3/1983 | France . |
| 2004585 | 4/1979 | United Kingdom . |

*Primary Examiner*—Andres Kashnikow
*Assistant Examiner*—Philippe Derakshani
*Attorney, Agent, or Firm*—Bacon & Thomas

[57] ABSTRACT

A hand sprayer including a piston and a piston valve suspended in an accumulator and moved downwards in the accumulator by the press head of the hand sprayer for permitting liquid to be forced out of the accumulator and then ejected out of the nozzle on the press head, wherein the piston has a plurality of longitudinal grooves on the inside wall around the longitudinal center through hole thereof for guiding liquid into small streams for permitting it to be further forced out of the nozzle into a mist of very fine drops of liquid; the piston valve has a horn-like bottom mouth, which air-tightly engages the peripheral wall of the bottom inductor chamber of the accumulator upon each down stroke of the piston.

2 Claims, 4 Drawing Sheets

HAND SPRAYER

BACKGROUND OF THE INVENTION

The present invention relates to hand sprayers, and relates more particularly to the piston and piston valve of a hand sprayer wherein the piston has inside longitudinal ribs for separating liquid into several small streams; the piston valve has a horn-like bottom mouth for close engagement with the periphery of the bottom inductor chamber of the accumulator.

FIG. 1 shows a regular hand sprayer which ejects a fixed amount of liquid in the form of a mist when depressed. As illustrated, the hand sprayer comprises a container H having a metal neck D, a container cap B covered on the metal neck D, a press head 1 movably mounted on the container cap B, an accumulator E suspended inside the container H, a dip tube J connected to the accumulator H at the bottom for guiding liquid from the container to the accumulator E, a piston A connected to the press head 1 and suspended in the accumulator E, a piston valve F coupled to the piston A and supported on a spring G inside the accumulator E. The operation of the hand sprayer includes two actions, namely, the first action of ejecting liquid out of the press head, and the second action of drawing liquid from the container H into the accumulator E. These two actions are continuously performed. As illustrated in FIG. 2, when the press head 1 is depressed to lower the piston A and the piston valve F, the piston valve F seals the lower half E2 of the accumulator E from the upper half E1 thereof, permitting accumulated liquid to be forced from the upper half E1 through the piston A to the press head 1 and then forced out of the nozzle on the press head 1, and at the same time the spring G is compressed. When the press head 1 is released, the spring G immediately pushes the piston valve F, the piston A, and the press head 1 back to their former positions, and therefore the upper half E1 and lower half E2 of the accumulator E are opened to each other again. During the up stroke of the piston valve F, a vacuum is formed in the upper half E1 of the accumulator E, causing a fixed amount of liquid to be drawn from the container H through the dip tube J into the accumulator E. Therefore, when the press head 1 is depressed again, a fixed amount of liquid is ejected out of the nozzle of the press head 1. This structure of hand sprayer is still not satisfactory in function. One drawback of this structure of hand sprayer is that it cannot effectively eject liquid out of the nozzle into a mist of very fine drops of liquid because of insufficient of pressure. Because liquid is guided to the nozzle of the press head in a single flow through the piston, high pressure is needed to force liquid out of the nozzle of the press head into a mist of fine drops of liquid. However, because the piston valve has a smooth periphery, gaps tend to occurs between the periphery of the piston valve and the inside wall of the accumulator.

SUMMARY OF THE INVENTION

The present invention has been accomplished to provide a hand sprayer which eliminates the aforesaid problem. It is one object of the present invention to provide a piston for hand sprayers which divides liquid into several small streams for permitting it to be effectively forced out of the nozzle of the press head into a mist of very fine drops of liquid. It is another object of the present invention to provide a piston valve for hand sprayers which provides a satisfactory air tight effect to facilitate accumulation of pressure in the accumulator. According to one aspect of the present invention, the hand sprayer is comprised of a container, a container cap covered on the container, a press head movably mounted on the container cap, an accumulator suspended inside the container and defining an upper accumulation chamber and a lower inductor chamber, a dip tube for guiding liquid from the container to the accumulator, a piston connected to the press head and suspended in the accumulator, a piston valve coupled to the piston and supported on a spring inside the inductor chamber, wherein the piston comprises a longitudinal through hole, a plurality of longitudinal ribs raised from an inside wall thereof around the longitudinal through hole, and a plurality of longitudinal grooves defined between the longitudinal ribs around the longitudinal through hole. According to another aspect of the present invention, the piston valve has a horn-like bottom mouth, which engages tightly the periphery of the bottom inductor chamber of the accumulator to separate the inductor chamber from the accumulation chamber upon each down stroke of the piston.

DETAILED DESCRIPTION OF THE PREFERRED EMBODIMENT

Figure 4:
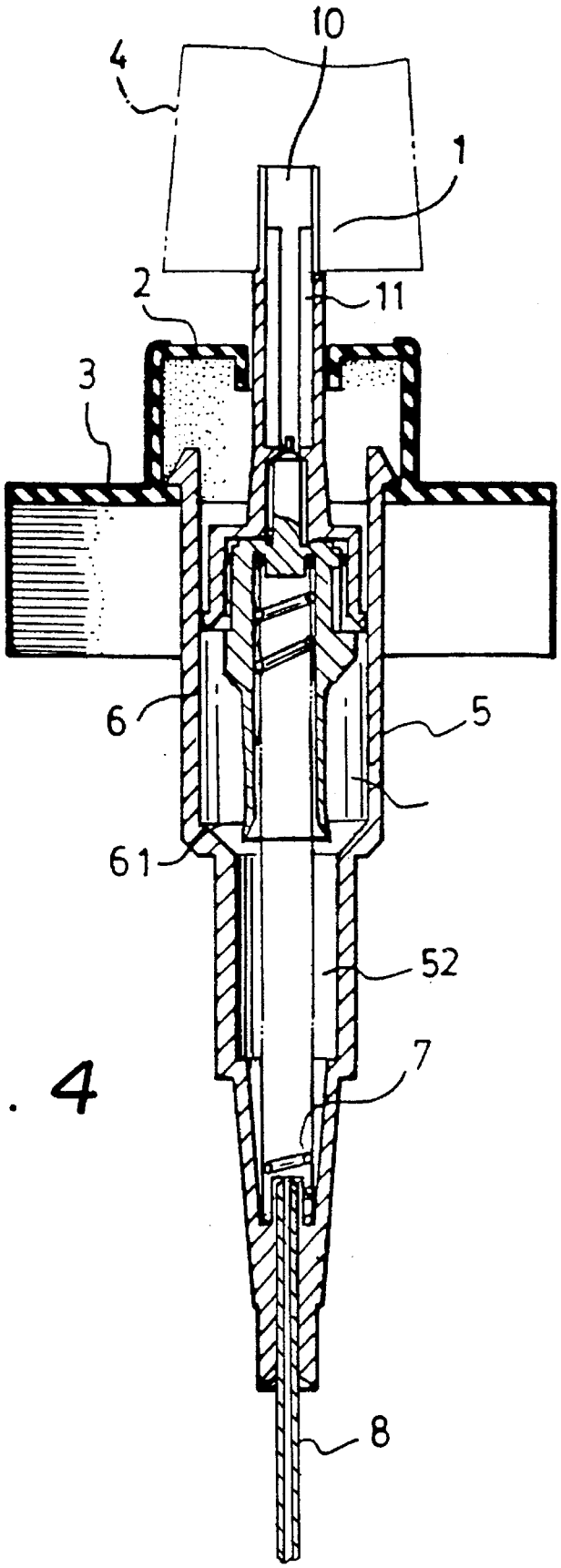
FIG. 4 shows the piston and piston valve of FIG. 3 installed in the hand sprayer according to the present invention.

Referring to FIGS. 4, a hand sprayer in accordance with the present invention is generally comprised of a piston 1, a container cap 2, a metal shield 3, a press head 4, an accumulator 5, a piston valve 6, a spring 7, and a dip tube 8. The accumulator 5 defines an accumulation chamber 51 at the top and an inductor chamber 52 at the bottom. When the press head 4 is depressed, liquid is forced out of the accumulation chamber 51 and ejected out of the press head 4 through a nozzle (not shown) thereof.

Figure 1:
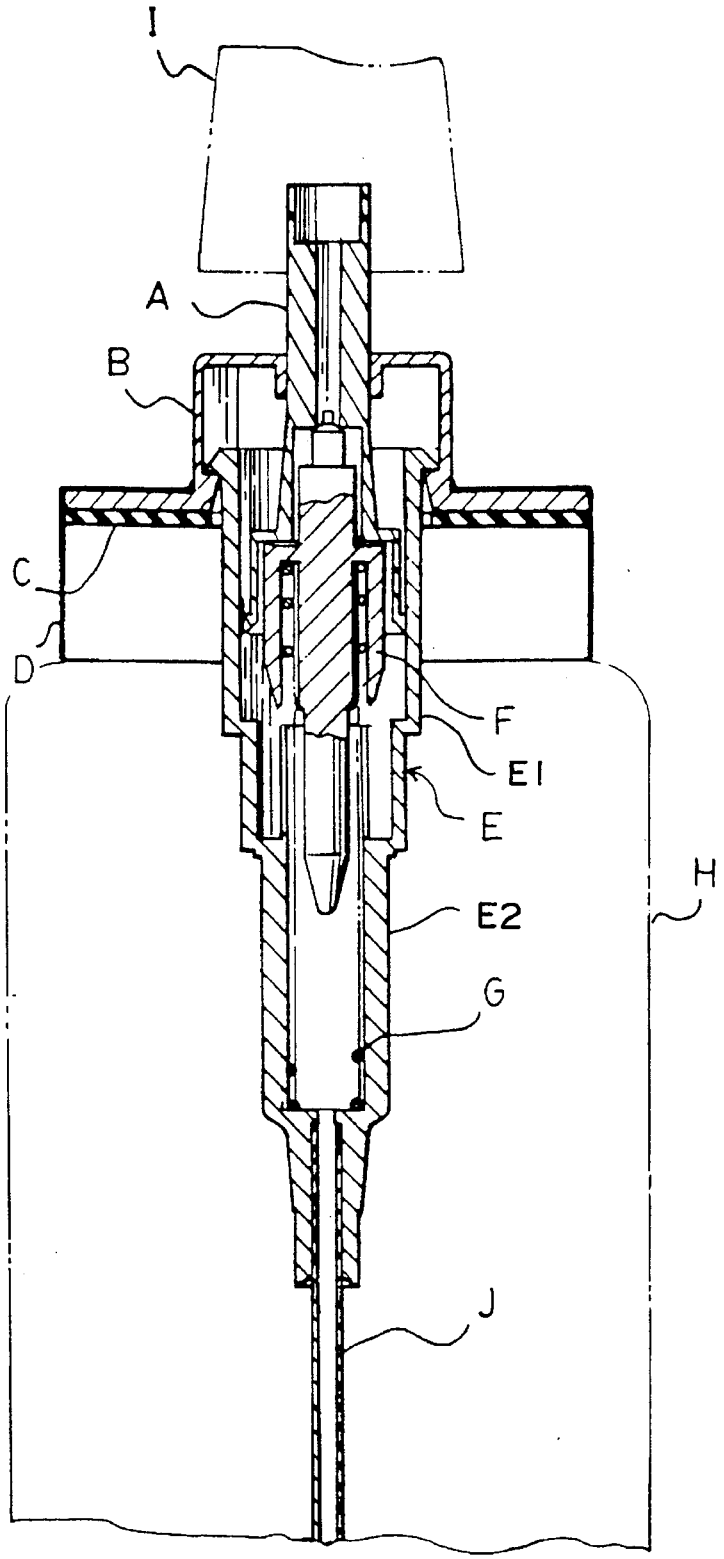
PRIOR ART FIG. 1
FIG. 1 is a longitudinal view in section of a hand sprayer according to the prior art.
Figure 2:
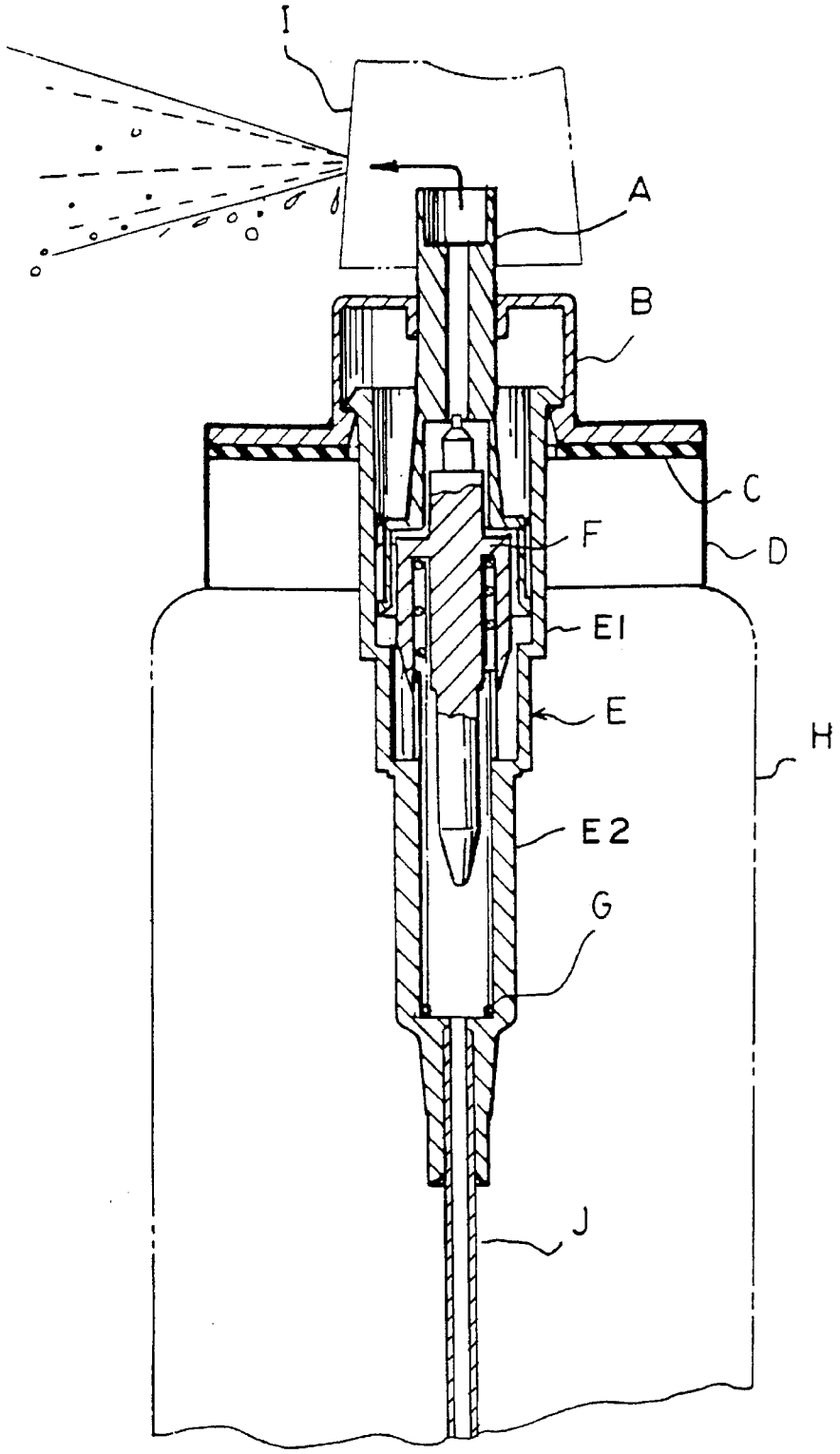
PRIOR ART FIG. 2
FIG. 2 shows the hand sprayer of FIG. 1 operated.
Figure 3A:
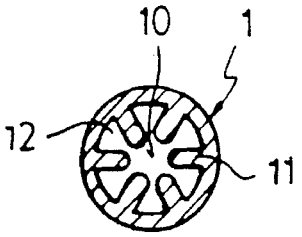
FIG. 3 is a dismantled view of the piston and the piston valve according to the present invention.
Figure 3:
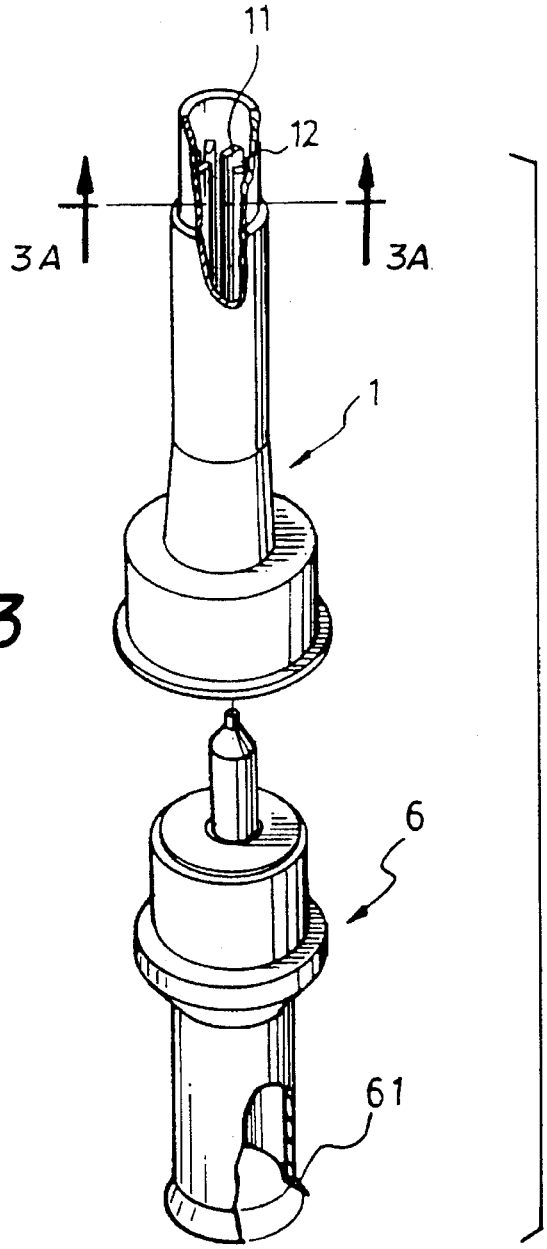

Referring to FIG. 3, the piston 1 comprises a longitudinal through hole 10, a plurality of longitudinal ribs 11 raised from the inside wall thereof around the longitudinal through hole 10, and a plurality of longitudinal grooves 12 defined between the longitudinal ribs 11 around the longitudinal through hole 10. The piston valve 6 has a horn-like bottom mouth 61. The inner diameter of the horn-like mouth 61 increases gradually toward the bottom.

Referring to FIG. 4 again, when the press head 4 of the hand sprayer is depressed, liquid is forced upwards from the accumulation chamber 51 to the nozzle of the press head 4 through the longitudinal through hole 10 and longitudinal grooves 12 of the longitudinal the piston 1. When passing through the piston 1, liquid is divided into several streams by the longitudinal ribs 11, and therefore when liquid is forced out of the nozzle of the press head 4 it forms into a mist of very fine drops of liquid. Furthermore, when the piston valve 6 is moved into the inductor chamber 52, the horn-like bottom mouth 61 closes contact the peripheral wall of the inductor chamber 52 to seal the inductor chamber 52 from the accumulation chamber 51, therefore pressure can be effectively accumulated in the accumulation chamber 51 for permitting liquid to be rapidly forced out of the accumulation chamber 51 to the nozzle of the press head 4 upon the down stroke of the piston 1.

It is to be understood that the drawings are designed for purposes of illustration only, and are not intended as a definition of the limits and scope of the invention disclosed.

I claim:

1. A hand sprayer comprising a container, a container cap covered on said container, a press head movably mounted on said container cap, an accumulator suspended inside said container and defining an upper accumulation chamber and a lower inductor chamber, a dip tube for guiding liquid from said container to said accumulator, a piston connected to said press head and suspended in said accumulator, a piston valve coupled to said piston and supported on a spring inside said inductor chamber, wherein said piston comprises a longitudinal through hole, a plurality of longitudinal ribs raised from an inside wall thereof around said longitudinal through hole, and a plurality of longitudinal grooves defined between said longitudinal ribs around said longitudinal through hole.

2. The hand sprayer of claim 1 wherein said piston valve has a horn-like bottom mouth, the inner diameter of said horn-like bottom mouth increases gradually toward the bottom.

* * * * *